US009288863B2

(12) United States Patent
Gilliom et al.

(10) Patent No.: US 9,288,863 B2
(45) Date of Patent: Mar. 15, 2016

(54) LIGHTING APPARATUS AND METHODS USING RECONFIGURABLE DIMMING MAPPING

(71) Applicant: Cree, Inc., Durham, NC (US)

(72) Inventors: Michael Burbank Gilliom, Raleigh, NC (US); Douglas E. Keiter, Apex, NC (US); Danwei Liu, Cary, NC (US); Michael Walters, Apex, NC (US)

(73) Assignee: Cree, Inc., Durham, NC (US)

( * ) Notice: Subject to any disclaimer, the term of this patent is extended or adjusted under 35 U.S.C. 154(b) by 309 days.

(21) Appl. No.: 13/826,401

(22) Filed: Mar. 14, 2013

(65) Prior Publication Data

US 2014/0265922 A1 Sep. 18, 2014

(51) Int. Cl.
*H05B 33/08* (2006.01)

(52) U.S. Cl.
CPC ..... *H05B 33/0848* (2013.01)

(58) Field of Classification Search
CPC ..... H05B 33/0815; H05B 33/0827; H05B 33/0848; H05B 37/029
USPC ..... 315/297
See application file for complete search history.

(56) References Cited

U.S. PATENT DOCUMENTS

| | | | | |
|---|---|---|---|---|
| 7,014,336 | B1 * | 3/2006 | Ducharme et al. | 362/231 |
| 8,487,272 | B2 * | 7/2013 | Tinsley | 250/458.1 |
| 2012/0299500 | A1 * | 11/2012 | Sadwick et al. | 315/224 |

* cited by examiner

*Primary Examiner* — John Poos
*Assistant Examiner* — David Mattison
(74) *Attorney, Agent, or Firm* — Myers Bigel & Sibley P.A.

(57) ABSTRACT

A lighting apparatus includes at least one light emitting device and a reconfigurable driver circuit configured to drive the at least one light emitting device with an intensity that varies responsive to a dimming signal according to an adjustable mapping of the dimming signal to output of the light emitting device. In some embodiments, the mapping may be configurable using circuit component selection. In further embodiments, the mapping may be provided by a data input.

20 Claims, 8 Drawing Sheets

LIGHTING APPARATUS AND METHODS USING RECONFIGURABLE DIMMING MAPPING

FIELD

The inventive subject matter relates to lighting apparatus and methods and, more particularly, to solid-state lighting apparatus and methods.

BACKGROUND

Solid-state lighting arrays are used for a number of lighting applications. For example, solid-state lighting panels including arrays of solid-state light emitting devices have been used as direct illumination sources in architectural and/or accent lighting. A solid-state light emitting device may include, for example, a packaged light emitting device including one or more light emitting diodes (LEDs), which may include inorganic LEDs, which may include semiconductor layers forming p-n junctions and/or organic LEDs (OLEDs), which may include organic light emission layers.

Solid-state lighting devices are often used in lighting fixtures, such as incandescent bulb replacement applications, task lighting, recessed light fixtures and the like. For example, Cree, Inc. produces a variety of light fixtures that use LEDs for illumination. The fixtures include can-type down lights, such as the LR-6 and CR-6, and troffer-type fixtures, such as the CR-24.

LEDs can be dimmed using, for example, linear dimming or pulse-width modulated (PWM) dimming. In a typical LED lighting apparatus, a microcontroller generates a PWM signal that is provided to a driver circuit that controls current passing through one or more LEDs. By varying the duty cycle of the PWM signal, the average current of the LEDs is proportionally changed, and the brightness of the LEDs varies accordingly.

Some conventional microcontroller-based dimming controllers implement linear dimming. Typically, the microcontroller samples a dimming control signal (e.g., from a commercial dimmer) and generates a PWM signal with its duty cycle varying with the dimming control signal. The PWM signal may be filtered with a low-pass filter, producing a DC voltage that is used to control a power stage of the driver circuit to adjust the LED current.

SUMMARY

Some embodiments provide a lighting apparatus including at least one light emitting device and a reconfigurable driver circuit configured to drive the at least one light emitting device with an intensity that varies responsive to a dimming signal according to an adjustable mapping of the dimming signal to output of the light emitting device. In some embodiments, the mapping may be configurable using circuit component selection. In further embodiments, the mapping may be provided by a data input.

In some embodiments, the driver circuit may include an analog filter that provides the mapping, which may be configurable by selection of a component of the analog filter, such as a feedback component. In some embodiments, the component selection may include a selection from a plurality of candidate components present in the driver circuit using, for example, one or more switches, fuses or other selection devices. In further embodiments, the component selection may include a component replacement in the driver circuit.

In some embodiments, the driver circuit may include a processor configured to control dimming of the at least one light emitting device, and a data input to provide a dimming mapping may include a data input for the processor. In some embodiments, the data input may include a lookup table. In further embodiments, the data input may include at least one parameter of a mathematical function that relates the dimming signal to light intensity. The at least one parameter may include at least one value of the mathematical function and/or a coefficient of the mathematical function.

In some embodiments, the reconfigurable driver circuit may include a reconfigurable dimming mapping circuit configured to receive a first dimming signal and to generate a second dimming signal according to the adjustable mapping and a driver circuit configured to receive the second dimming signal and to vary illumination intensity of the at least one light emitting device responsive thereto. In some embodiments, the dimming mapping circuit may include a reconfigurable analog filter circuit configured to generate the second dimming signal. In some embodiments, the dimming mapping circuit may include a processor circuit configured to generate the second dimming signal.

According to some embodiments, the first dimming signal may include a phase cut dimming signal and the dimming mapping circuit may include an average circuit configured to receive the phase cut dimming signal and to generate an average signal therefrom and a reconfigurable mapping circuit configured to receive the average signal and to generate the second dimming signal therefrom according to the adjustable mapping.

Further embodiments of the inventive subject matter provide an apparatus including an input configured to receive a dimming signal, an output configured to be coupled to at least one lighting device and a reconfigurable driver circuit coupled to the output and configured to drive the at least one light emitting device with an intensity that varies responsive to the dimming signal according to an adjustable mapping. The mapping may be configurable using circuit component selection and/or a data input.

The reconfigurable driver circuit may include a reconfigurable dimming mapping circuit configured to receive a first dimming signal and to generate a second dimming signal according to the adjustable mapping and a driver circuit configured to receive the second dimming signal and to vary illumination intensity of the at least one light emitting device responsive thereto.

In additional embodiments, an apparatus includes an input configured to receive a dimming signal, an output configured to be coupled to at least one lighting device and a reconfigurable dimming mapping circuit coupled to the output and configured apply an adjustable mapping to the received dimming signal to provide a remapped dimming signal to the at least one lighting device. The mapping may be configurable using circuit component selection and/or a data input. The apparatus may be configured as a module configured to interface a dimmer to the at least one lighting device.

BRIEF DESCRIPTION OF THE DRAWINGS

The accompanying drawings, which are included to provide a further understanding of the inventive subject matter and are incorporated in and constitute a part of this application, illustrate certain embodiment(s) of the inventive subject matter. In the drawings.

DETAILED DESCRIPTION

Figure 1:
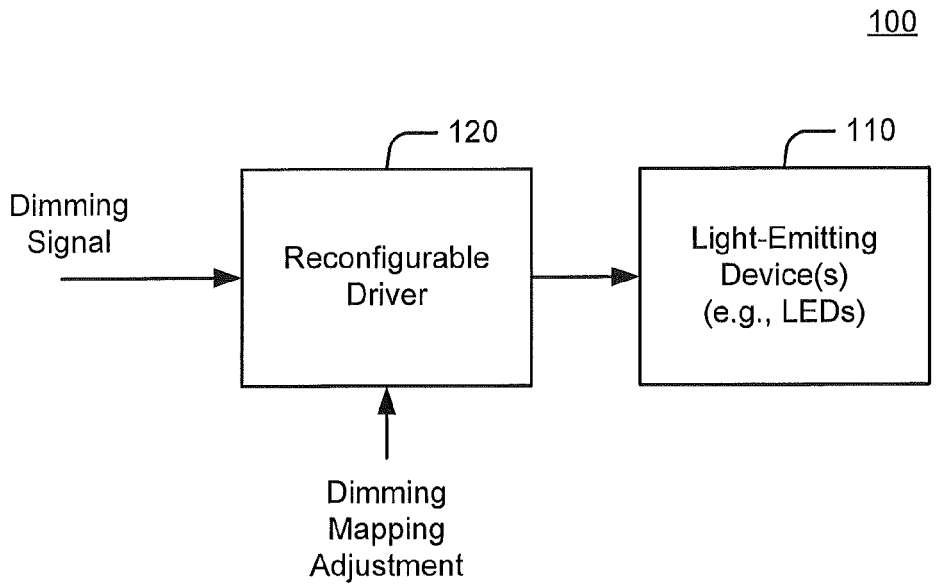
FIG. 1 illustrates a lighting apparatus according to some embodiments.

Embodiments of the inventive subject matter now will be described more fully hereinafter with reference to the accompanying drawings, in which embodiments of the inventive subject matter are shown. This inventive subject matter may, however, be embodied in many different forms and should not be construed as limited to the embodiments set forth herein. Rather, these embodiments are provided so that this disclosure will be thorough and complete, and will fully convey the scope of the inventive subject matter to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the inventive subject matter. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. It will be further understood that elements "coupled in series" or "serially connected" may be directly coupled or may be coupled via intervening elements.

Spatially relative terms, such as "below", "beneath", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation, in addition to the orientation depicted in the figures. Throughout the specification, like reference numerals in the drawings denote like elements.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this inventive subject matter belongs. It will be further understood that terms used herein should be interpreted as having a meaning that is consistent with their meaning in the context of this specification and the relevant art and will not be interpreted in an idealized or overly formal sense unless expressly so defined herein. The term "plurality" is used herein to refer to two or more of the referenced item.

The expression "lighting apparatus", as used herein, is not limited, except that it indicates that the device is capable of emitting light. That is, a lighting apparatus can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting, work lights, etc., mirrors/vanity lighting, or any other light emitting device. The inventive subject matter may further relate to an illuminated enclosure (the volume of which can be illuminated uniformly or non-uniformly), including an enclosed space and at least one lighting apparatus according to the inventive subject matter, wherein the lighting apparatus illuminates at least a portion of the enclosed space (uniformly or non-uniformly).

Some embodiments of the inventive subject matter arise from a realization that in lamp replacement applications, such as those that substitute LED lamps for incandescent or fluorescent lamps, it may be desirable to match dimming characteristics of the replacement lamp with that of the lamp being replaced. According to some embodiments, this may be achieved by using a reconfigurable dimming mapping that may be adjusted to provide desired dimming characteristics for various applications.

FIG. 1 illustrates a lighting apparatus 100 according to some embodiments of the inventive subject matter. The lighting apparatus 100 includes at least one light emitting device 110, such as plurality of light emitting diodes (LEDs). The apparatus 100 further includes a reconfigurable driver circuit 120, which is configured to drive the at least one light emitting device 110 responsive to a dimming signal. The reconfigurable driver circuit 120 is configured to apply a mapping for dimming the light output of the at least one light emitting device 110 that may be varied according to a dimming mapping adjustment. As explained below, in some embodiments, the mapping may be achieved using an analog mapping circuit that applies a mapping that is dependent upon a selectable component, such as feedback component in a filter that processes the input dimming signal. In some embodiments, the mapping may be performed by a microcontroller or other data processing device. The mapping may also provide conversion between a dimming signal having a first form, e.g., a phase cut dimming signal, and a second form, such as a pulse-width modulated signal or a voltage level.

Figure 2:
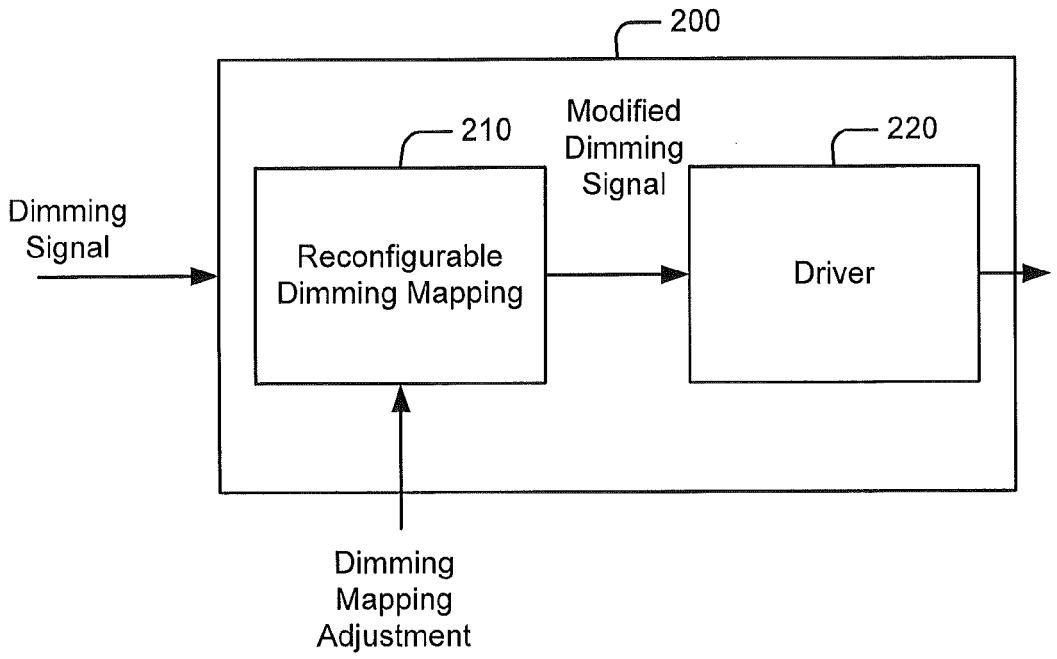
FIG. 2 illustrates a reconfigurable driver circuit with adjustable dimming mapping according to some embodiments.

Referring to FIG. 2, a reconfigurable driver circuit 200 according to some embodiments may include a driver circuit 220 and a reconfigurable dimming mapping circuit 210 that provides a modified dimming signal to the driver circuit 220. The driver circuit 220 is configured to drive at least one light emitting device, such as a string of LEDs with an intensity that is controlled by the modified dimming signal. The driver circuit 220 may have any of a number of different forms. For example, in some embodiments, the driver circuit 220 may be a pulse-width modulation circuit that includes a transistor or other switching device that is coupled in series with one or more LEDs and configured to modulate a current passing therethrough responsive to the modified dimming signal. In some embodiments, the driver circuit may be a linear or switchmode current control circuit (e.g., a current source or sink) that is used to control circuit current to one or more LEDs, with the current level being controlled responsive to the modified dimming signal, which may take the form, for example, of an analog voltage. It will be understood that various other types of driver circuits that may be used for the driver circuit 220 in various embodiments of the inventive subject matter. The reconfigurable dimming mapping circuit 200 is configured to generate the modified dimming signal from an input dimming signal according to a dimming mapping that may be varied responsive to a dimming mapping adjustment input.

Figure 3:
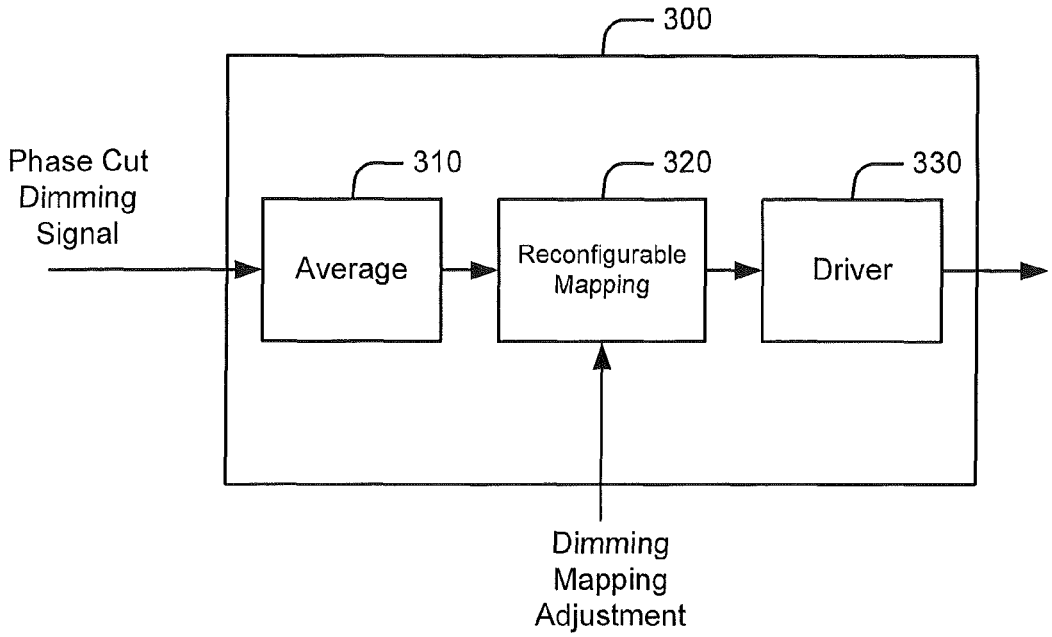
FIG. 3 illustrates a reconfigurable driver circuit for a lighting apparatus according to further embodiments.

FIG. 3 illustrates an example in which a phase cut dimming signal is applied to a reconfigurable driver circuit 300 according to some embodiments. The reconfigurable driver circuit 310 includes an averaging circuit 310, which is configured to generate an average signal representative of an average magnitude of a rectified phase cut dimming signal. The average signal is provided to reconfigurable mapping circuit 320, which is configured to apply a mapping that may be adjusted responsive to a dimming mapping adjustment. A modified dimming signal generated by the reconfigurable mapping circuit 320 is applied to a driver circuit 330, which may responsively drive one or more LEDs or other light emitting devices.

Figure 4:
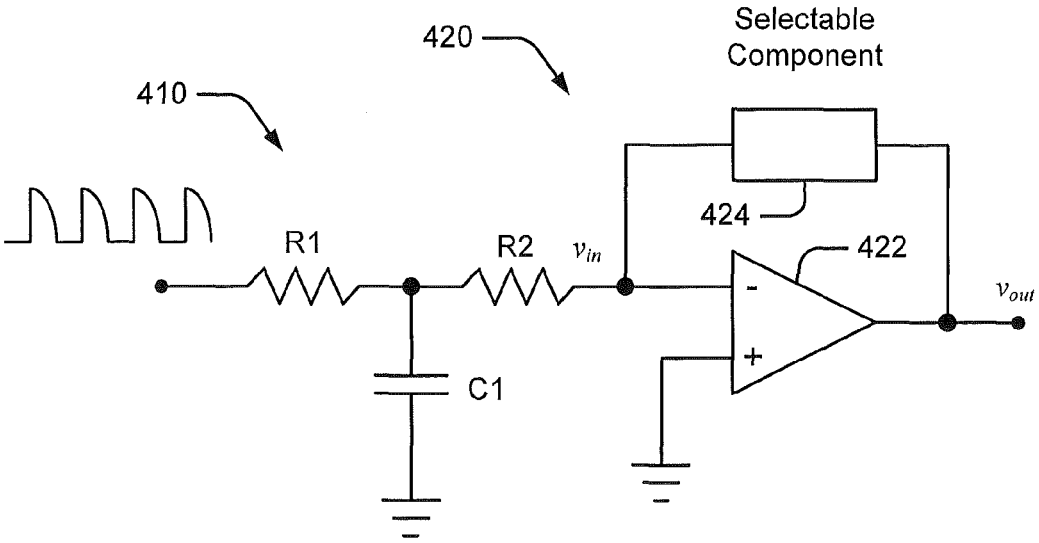
FIG. 4 illustrates an analog circuit implementation of a dimming mapping circuit according to some embodiments.
Figure 5:
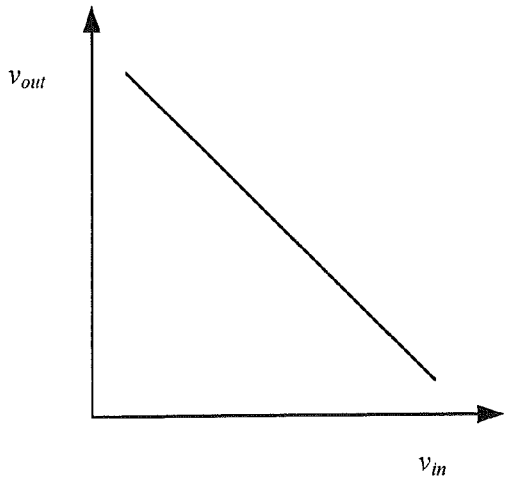
FIGS. 5 and 6 illustrate examples of dimming mappings that may be provided by the circuit of FIG. 4.
Figure 6:
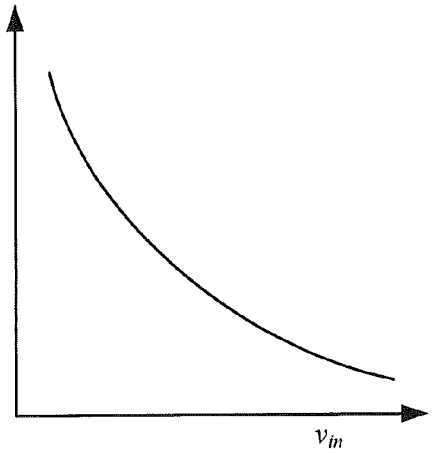

FIG. 4 illustrates an analog circuit implementation of a combination of an average circuit and a reconfigurable mapping circuit according to some embodiments. An average circuit 410 includes an RC filter including a resistor R1 and a capacitor C1. The average circuit 410 receives a rectified phase cut AC signal at an input thereof, and produces an average signal $v_{in}$ therefrom. The average signal $v_{in}$, is applied to an input of a mapping circuit, here shown as an active filter circuit 420 including an operational amplifier 422, an input resistor R2 and a selectable feedback component 424. The selectable feedback component 422 may include, for example, a component that may be trimmed, substituted, switched or otherwise selectively placed in the feedback path of the filter circuit 420 to determine a mapping between the average signal $v_{in}$, and an output dimming signal $v_{out}$. Referring to FIG. 5, if a resistor is selected for the selectable feedback component 424, a linear mapping may be provided, with a slope that is determined by the resistance value. Referring to FIG. 6, if a diode is selected, for example, a non-linear mapping may be provided. It will be appreciated that other component arrangements may provide other mappings. For example, higher-order filter arrangements may provide polynomial or other nonlinear mappings.

Figure 7:
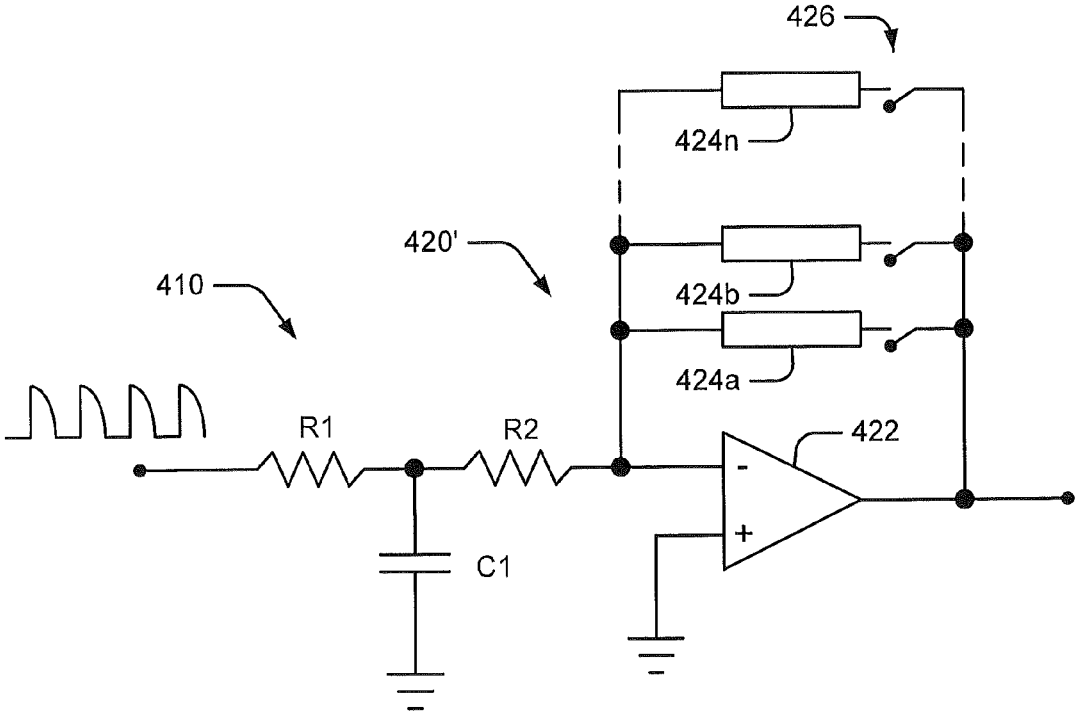
FIG. 7 illustrates an analog circuit implementation of a dimming mapping circuit according to further embodiments.

Referring to FIG. 7, a mapping filter circuit 420' may be configured to provide a plurality of feedback components 424*a*, 424*b*, . . . 424*n* that may be selected using a switch assembly 726 or similar circuitry. In particular, one of the plurality of feedback components 424*a*, 424*b*, . . . 424*n* may be placed in the feedback path of the filter circuit 420' by closing its associated switch element while leaving the others of the plurality of feedback components 424*a*, 424*b*, . . . 424*n* disconnected. It will be appreciated that similar selection functionality may be provided using fuses or other selection devices.

Figure 8:
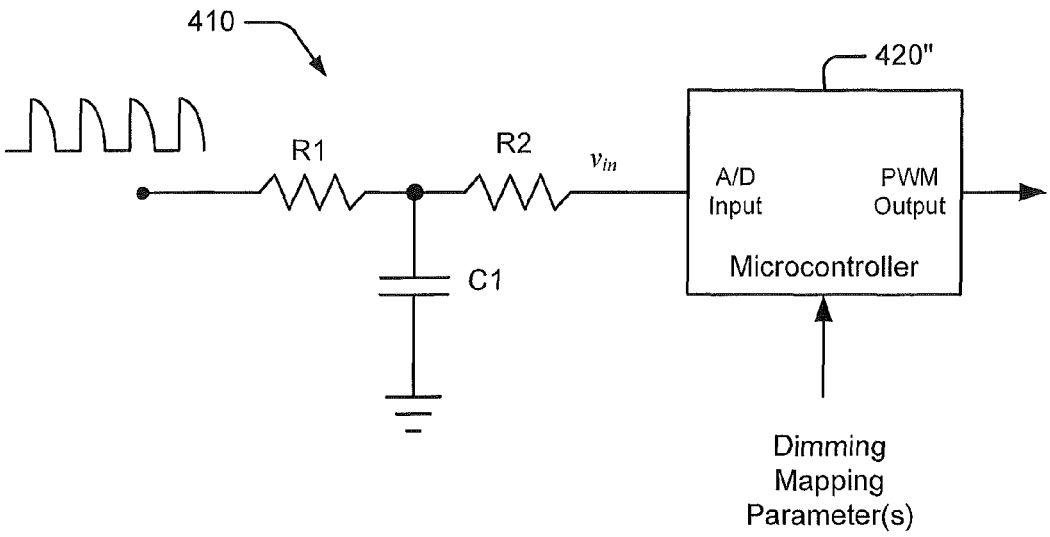
FIG. 8 illustrates a microcontroller-based implementation of a dimming mapping circuit according to some embodiments.
Figure 9:
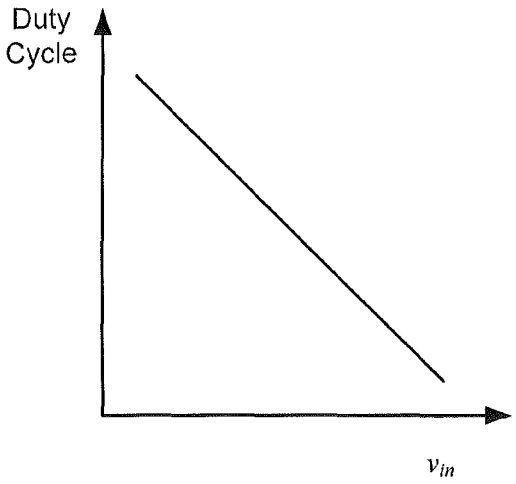
FIGS. 9 and 10 illustrate examples of mappings that may be provided by the circuit of FIG. 8.
Figure 10:
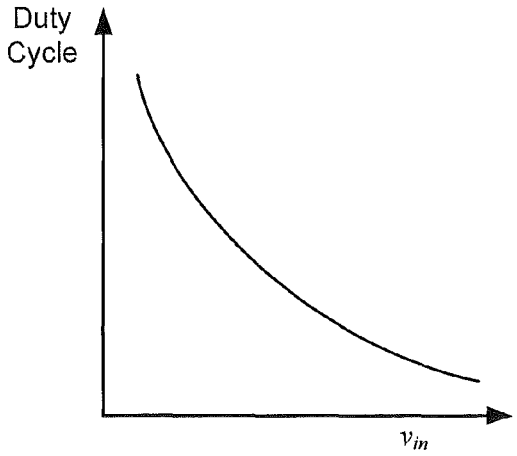

FIG. 8 illustrates another arrangement that uses a microcontroller 420" rather than an analog filter. An average circuit 410 provides an average signal to an analog-to-digital (A/D) converter input of the microcontroller 420". The microcontroller 420" maps the average signal $v_{in}$ to a pulse-width modulation (PWM) signal, which may be used to drive one or more light emitting devices. The mapping applied by the microcontroller 420" is adjustable according to one or more received dimming mapping parameters. As shown in FIGS. 9 and 10, the microcontroller 420" may be selectively configured to provide linear or nonlinear mapping of the average signal $v_{in}$ to the duty cycle of the PWM output.

The dimming mapping parameters may be provided, for example, as a data input to a memory (e.g., EPROM, EEPROM, flash memory, or the like) incorporated in and/or accessed by the microcontroller 420." The mapping parameters may be programmed as a part of a calibration process during production. In some embodiments, a lamp or other lighting device may be designed to flexibly serve in multiple different replacement applications, and dimming mapping parameters may be programmed into the device during production based on the application for which the device is intended for use. The mapping parameters may also be programmed after deployment in the field, manually (e.g., by users or service personnel) and/or remotely via wireless or other communications channels.

In various embodiments, the mapping provided by a microcontroller or other data processing device used to provide dimming mapping may be implemented in any of a number of different ways. For example, the microcontroller 420 may store or access a lookup table that indexes values of the average signal $v_{in}$ to duty cycle values for the PWM dimming signal. In some embodiments, the microcontroller 420 may store or access a parametric formula, e.g., a polynomial, logarithmic or other function, that provides the dimming mapping, which may be adjusted by providing different coefficient sets for use in the formula. The dimming mapping parameters applied by the microcontroller 420" may be set of coordinate values, and the microcontroller 420' may use curve fitting and/or interpolation techniques to generate a dimming mapping from these values.

Figure 11:
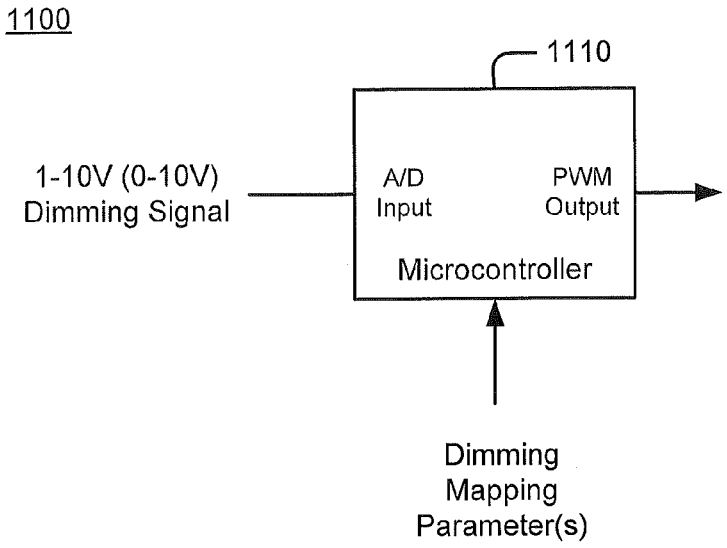
FIGS. 11 and 12 illustrate microcontroller-based dimming mapping circuits according to further embodiments.
Figure 12:
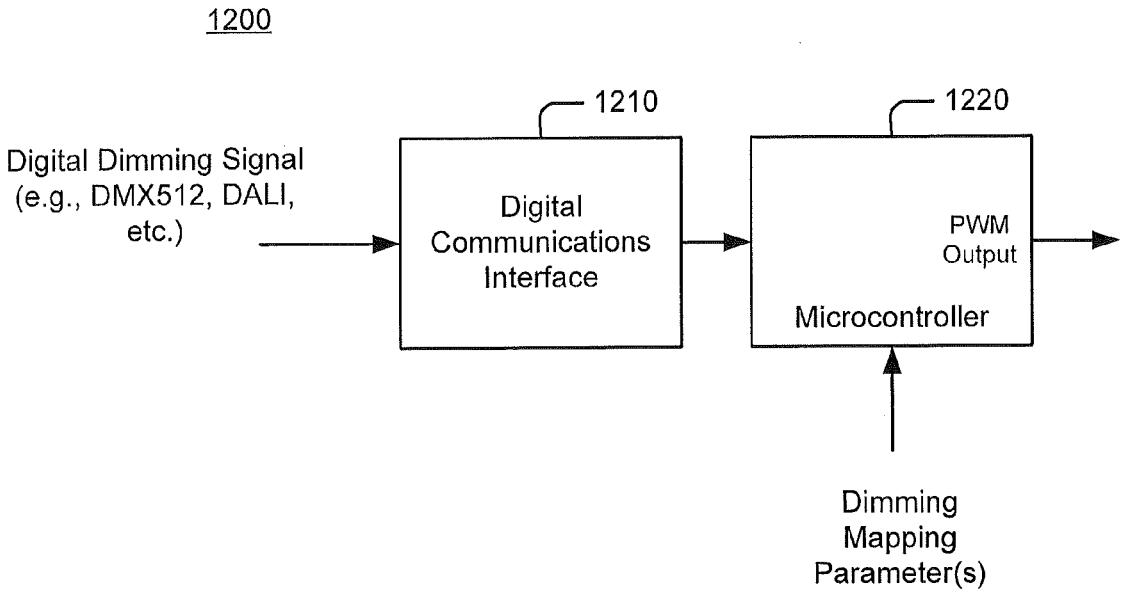

In further embodiments, adjustable dimming mapping may be provided for dimming signals other than phase cut dimming signals. For example, as shown in FIG. 11, a microcontroller 1110 that provides a PWM control signal for dimming a lighting device may receive a so-called 1-10V or 0-10V dimming input signal, and may adjustably map the dimming input signal to the PWM control signal. As shown in FIG. 12, a microcontroller a microcontroller 1110 that provides a PWM control signal for dimming a lighting device may receive a dimming signal via digital communications interface circuit 1210 that is configured to receive digital dimming signals conforming to standards, such as DMX512 or DALI. The microcontroller 1220 may adjustably map the input dimming signal to the PWM control signal.

Figure 13:
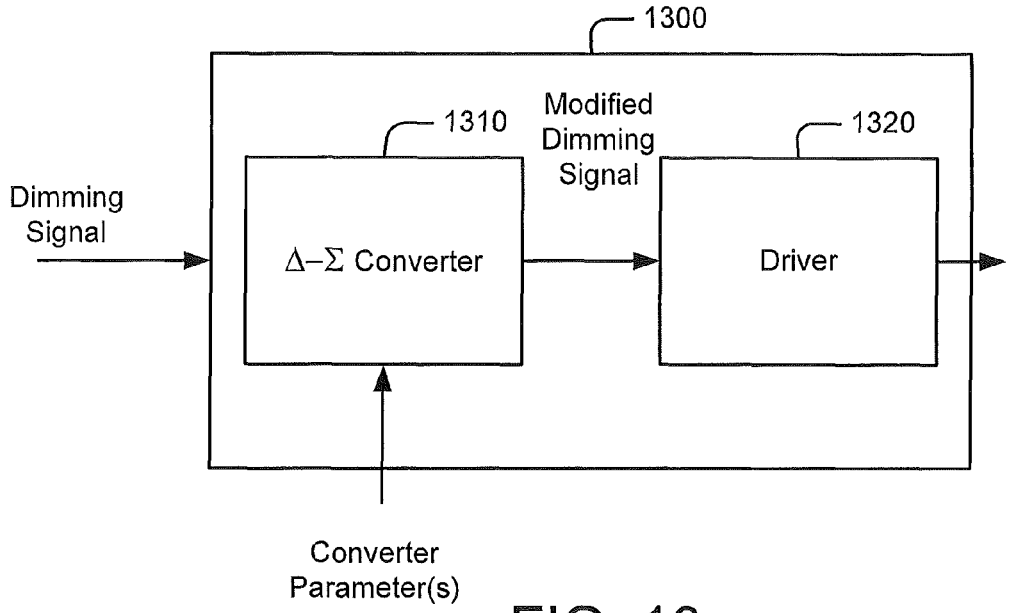
FIG. 13 illustrates a dimming mapping circuit including a delta-sigma converter according to some embodiments.

Still further embodiments may use reconfigurable converters, such as delta-sigma converters, to implement adjustable dimming mapping. FIG. 13 illustrates a reconfigurable driver circuit 1300 according to some embodiments. The driver circuit 1300 includes a delta-sigma converter circuit 1310 configured to receive a dimming signal and to generate a modified dimming signal therefrom. The modified dimming signal is applied to a driver circuit 1320, which may drive, for example, one or more LEDs. The mapping applied by the delta-sigma converter circuit 1310 may be adjusted by varying one or more parameters of the delta sigma converter circuit 1310.

Figure 14:
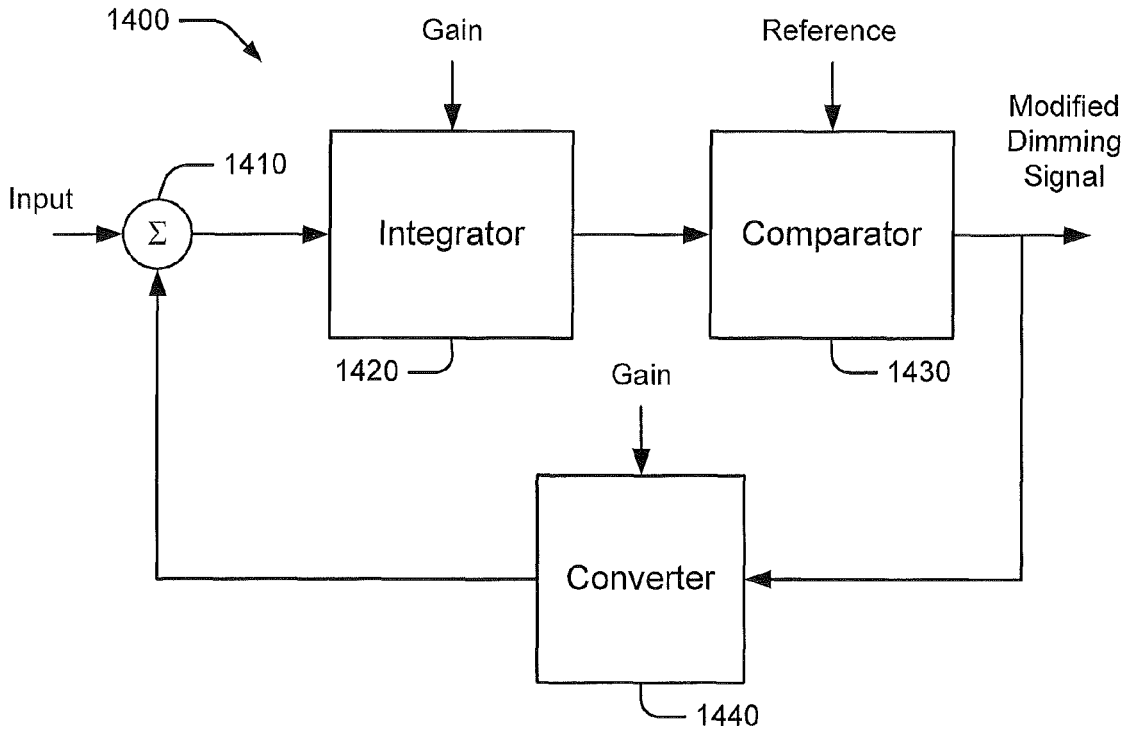
FIG. 14 illustrates a delta-sigma modulator the may be used in the dimming mapping circuit of FIG. 13 according to some embodiments.

FIG. 14 illustrates an example of a delta sigma converter 1400 that may be used for adjustable dimming mapping according to some embodiments. The converter 1400 includes a summer 1410, which is configured to receive an input signal, such as a dimming signal, and a feedback signal from a converter 1440. An integrator 1420 integrates an error signal produced by the summer 1410, producing an output that is applied to a comparator 1430. The comparator 1430 compares the output of the integrator 1420 to a reference, and generates an output based on the comparison. The output of the comparator 1430 is fed back to the summer via a converter 1440. It will be appreciated that a delta-sigma converter such as the converter 1400 shown in FIG. 14 may be an analog or digital circuit, e.g., the input signal provided to the summer 1410 may be an analog signal or a digital signal, the integrator 1420 may be an analog or digital integrator, and the comparator 1430 may be an analog or digital comparator. The output of the comparator 1430 may be a pulse width modulated signal that corresponds to a level of the input signal applied to the summer 1410, which may be a dimming signal. The output of the comparator 1430 may be used as a dimming input for a driver circuit, such as one used to drive LEDs. The mapping of the input signal to the output of the comparator 1430 generally may depend on parameters such as the gain of the integrator 1420, the reference of the comparator and the gain of the feedback converter 1440. According to various embodiments, one or more of these parameters may be varied to provide variable dimming mapping.

Figure 15:
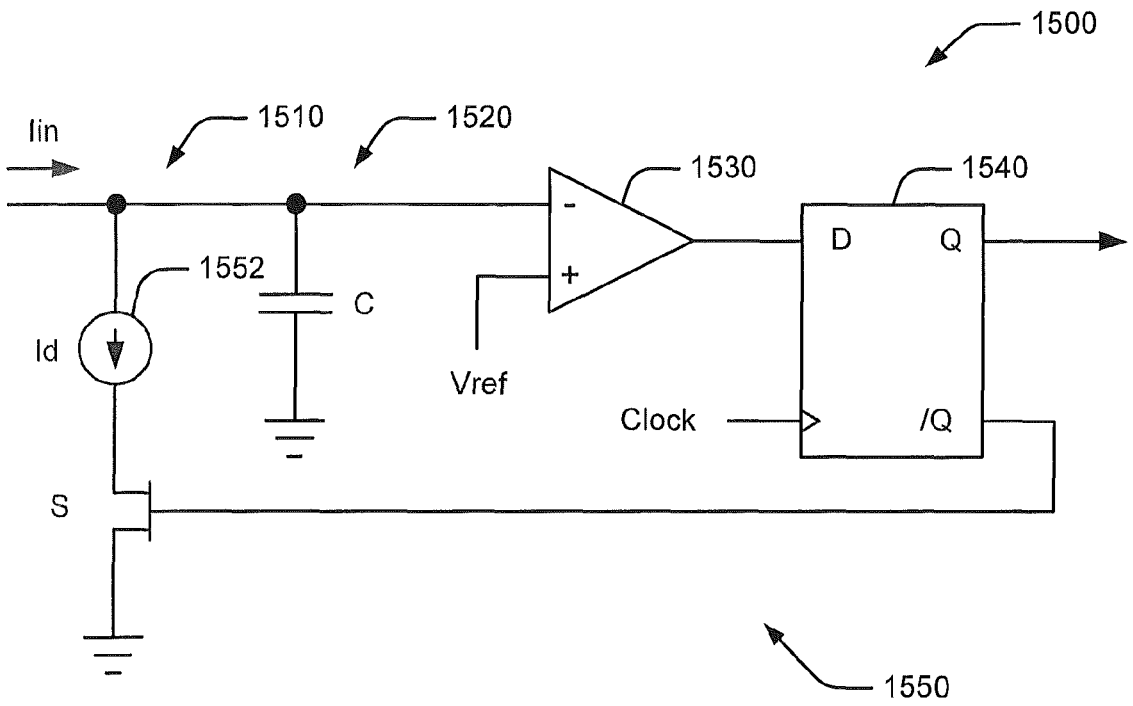
FIG. 15 illustrates an example circuit implementation of a delta-sigma converter according to further embodiments.

FIG. 15 illustrates an analog implementation of a delta sigma converter 1500 that may be used in some embodiments. The delta sigma converter 1500 includes a node 1510 that serves as a summing junction to which an input signal in the form of a current Iin is applied. An integrator circuit 1520 includes a capacitor C, which is charge by current from the summing junction node 1510. The output of the integrator circuit 1520 is applied to one input of an analog comparator circuit 1530, which has another input that receives a reference voltage Vref. The output of the comparator circuit 1530 is clocked through a D flip-flop circuit 1540 responsive to a clock signal CLK to produce an output signal at an output terminal Q. A complementary output/Q of the D flip-flop circuit 1540 is fed back to a control terminal of a transistor switch S that selectively enables and disables a current Id through a current source circuit 1552 from the summing junction node 1510. This circuitry may be viewed as providing the function of a one-bit A/D that converts the digital output of the D flip-flop circuit 1540 to an analog current combined with the input current Iin at the summing junction node 1510.

The input/output mapping provided by the converter 1500 may be varied by varying one or more parameters of the converter 1500. Such parameters may include, for example, the feedback current magnitude Id, the integrator capacitance C, the comparator reference voltage Vref and the frequency of the clock signal CLK. These parameters may be adjusted, for example, responsive to one or more control signals. For example, the feedback current magnitude Id may be adjusted responsive to a bias voltage or other control signal applied to the current source circuit 1552, and the integrator capacitance C may comprise, for example, a capacitor bank and/or varactor that may be adjusted responsive to a control signal. One or more of these parameters may also be a function of a dimming command signal.

Figure 16:
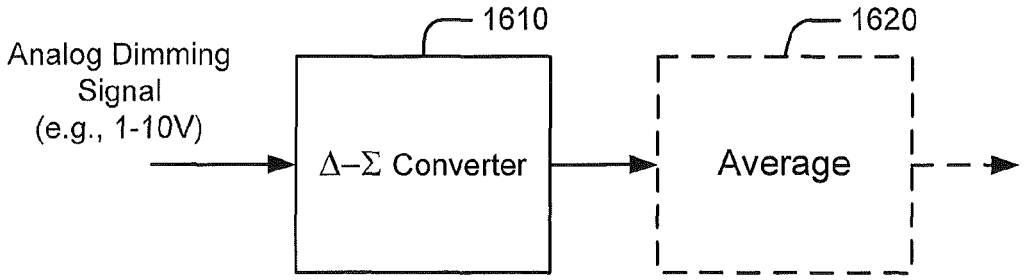
FIGS. 16 and 17 illustrate various arrangements for dimming mapping using a delta-sigma converter according to some embodiments.
Figure 17:
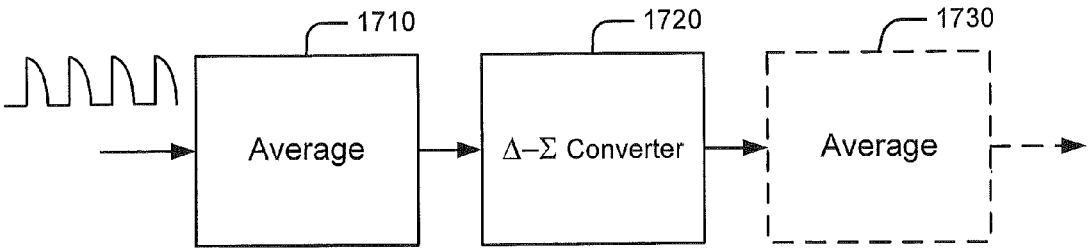

Such delta-sigma converter based circuits may be used in a number of different ways in various embodiments. For example, as shown in FIG. 16, an analog dimming signal (e.g., a 1-10V dimming signal) may be applied to a reconfigurable delta-sigma converter 1610, which responsively produces a pulse-width modulated signal that may be used directly as an input for an LED drive circuit. In some embodiments, this pulse-width modulated signal may be processed in an average circuit 1620 (e.g., a low pass filter) to generate an analog voltage that is used to control a drive circuit. As shown in FIG. 17, a phase cut dimming signal may be applied to an average circuit 1710, which may produce an analog signal that is applied to a delta-sigma converter 1720 that provides a variable dimming mapping. The pulse width modulated output of the delta-sigma converter 1720 may be used directly, or may be processed in an average circuit 1730 to produce an analog dimming signal.

Figure 18:
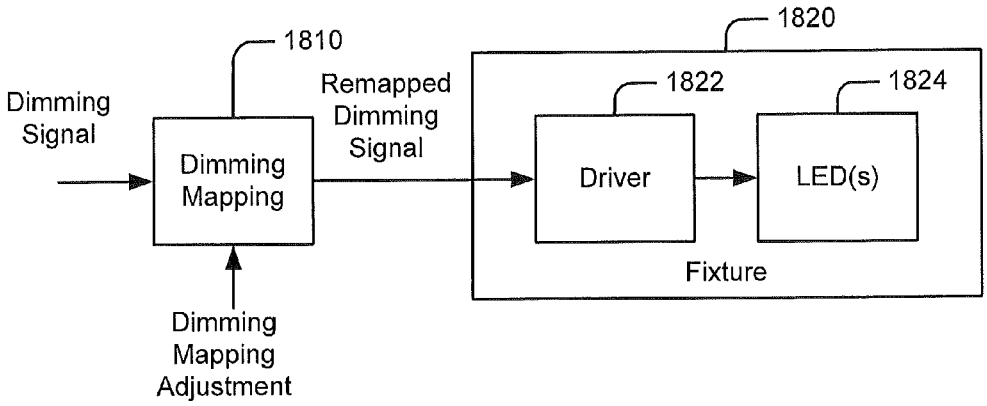
FIG. 18 illustrates a dimming mapping circuit implemented as an interface module or unit according to some embodiments.

Some embodiments of the inventive subject matter may be implemented as part of a lighting fixture or other lighting unit, e.g., integrated with driver, power supply and/or other components. As shown in FIG. 18, in further embodiments, a dimming mapping circuit 1810 may be implemented as a module or unit that is configured to interface a dimmer, such as a phase cut dimmer, to a fixture 1820, here shown as including a driver circuit 1822 and one or more LEDs 1824.

It will be appreciated that the adjustable dimming mapping circuitry described above is provided for purposes of illustration, and that some embodiments of the inventive subject matter may use other circuit implementations. For example, analog and/or digital implementations may provide mappings that are dependent upon reference or command voltages and/or currents that are provided to the mapping circuitry.

In the drawings and specification, there have been disclosed typical embodiments of the inventive subject matter and, although specific terms are employed, they are used in a generic and descriptive sense only and not for purposes of limitation, the scope of the inventive subject matter being set forth in the following claims.

What is claimed is:

1. A lighting apparatus, comprising:

at least one light emitting device; and a reconfigurable driver circuit configured to drive the at least one light emitting device with an intensity that varies responsive to a dimming signal according to an adjustable mapping of the dimming signal to output of the light emitting device, wherein the mapping is configurable using circuit component selection, and wherein the includes selection among linear and nonlinear circuit components.

2. The lighting apparatus of claim 1, wherein the driver circuit comprises an analog filter that provides the mapping and wherein the mapping is configurable by selection of a component of the analog filter.

3. The lighting apparatus of claim 1, wherein the component selection comprises a selection from a plurality of candidate components present in the driver circuit.

4. The lighting apparatus of claim 1, wherein the component selection comprises a component replacement in the driver circuit.

5. The lighting apparatus of claim 1, wherein the mapping is configurable using a data input.

6. The lighting apparatus of claim 5, wherein the driver circuit comprises a processor configured to control dimming of the at least one light emitting device, and wherein the data input comprises a data input for the processor.

7. The lighting apparatus of claim 5, wherein the data input comprises a lookup table.

8. The lighting apparatus of claim 5, wherein the data input comprises at least one parameter of a mathematical function that relates the dimming signal to light intensity.

9. The lighting apparatus of claim 7, wherein the at least one parameter comprises at least one value of the mathematical function and/or a coefficient of the mathematical function.

10. The lighting apparatus of claim 7, wherein the reconfigurable driver circuit comprises:

a reconfigurable dimming mapping circuit configured to receive a first dimming signal and to generate a second dimming signal according to the adjustable mapping; and a driver circuit configured to receive the second dimming signal and to vary illumination intensity of the at least one light emitting device responsive thereto.

11. The lighting apparatus of claim 10, wherein the dimming mapping circuit comprises a reconfigurable analog filter circuit configured to generate the second dimming signal.

12. The lighting apparatus of claim 10, wherein the dimming mapping circuit comprises a processor circuit configured to generate the second dimming signal.

13. The lighting apparatus of claim 10, wherein the dimming mapping circuit comprises a reconfigurable delta-sigma converter configured to generate the second dimming signal.

14. The lighting apparatus of claim 10, wherein the first dimming signal comprises a phase cut dimming signal and wherein the dimming mapping circuit comprises:

an average circuit configured to receive the phase cut dimming signal and to generate an average signal therefrom; and a reconfigurable mapping circuit configured to receive the average signal and to generate the second dimming signal therefrom according to the adjustable mapping.

15. An apparatus comprising:

an input configured to receive a dimming signal;

an output configured to be coupled to at least one lighting device; and a reconfigurable driver circuit coupled to the output and configured to drive the at least one light emitting device with an intensity that varies responsive to the dimming signal according to an adjustable mapping.

16. The apparatus of claim 15, wherein the mapping is configurable using circuit component selection, a control signal and/or a data input.

17. The lighting apparatus of claim 14, wherein the reconfigurable driver circuit comprises:

a reconfigurable dimming mapping circuit configured to receive a first dimming signal and to generate a second dimming signal according to the adjustable mapping; and a driver circuit configured to receive the second dimming signal and to vary illumination intensity of the at least one light emitting device responsive thereto.

18. An apparatus comprising:

an input configured to receive a dimming signal;

an output configured to be coupled to at least one lighting device; and a reconfigurable dimming mapping circuit coupled to the output and configured apply an adjustable mapping to the received dimming signal to provide a remapped dimming signal to the at least one lighting device.

19. The apparatus of claim 18, wherein the mapping is configurable using circuit component selection, a control signal and/or a data input.

20. The apparatus of claim 18, configured as a module configured to interface a dimmer to the at least one lighting device.

* * * * *